US011091861B2

(12) United States Patent
Sommer et al.

(10) Patent No.: US 11,091,861 B2
(45) Date of Patent: Aug. 17, 2021

(54) SPUNBONDED NONWOVEN WITH CRIMPED FINE FIBERS

(71) Applicants: Fibertex Personal Care A/S, Aalborg (DK); Reifenhauser GmbH & Co. KG Maschinenfabrik, Troisdorf (DE)

(72) Inventors: Sebastian Sommer, Troisdorf (DE); Morten Rise Hansen, Aalborg (DK)

(73) Assignees: FIBERTEX PERSONAL CARE A/S, Aalborg (DK); REIFENHAUSER GMBH & CO. KG MASCHINENFABRIK, Troisdorf (DE)

( * ) Notice: Subject to any disclaimer, the term of this patent is extended or adjusted under 35 U.S.C. 154(b) by 123 days.

(21) Appl. No.: 16/253,593

(22) Filed: Jan. 22, 2019

(65) Prior Publication Data

US 2019/0233993 A1 Aug. 1, 2019

(30) Foreign Application Priority Data

Jan. 31, 2018 (EP) ..... 18154375

(51) Int. Cl.
*D04H 3/00* (2012.01)
*D04H 3/018* (2012.01)
(Continued)

(52) U.S. Cl.
CPC ..... *D04H 3/018* (2013.01); *D01D 5/0985* (2013.01); *D01D 5/22* (2013.01); *D01F 1/10* (2013.01);
(Continued)

(58) Field of Classification Search
CPC ..... D04H 3/00
See application file for complete search history.

(56) References Cited

U.S. PATENT DOCUMENTS 5,213,881 A * 5/1993 Timmons ..... D04H 1/559 156/167
5,587,225 A * 12/1996 Griesbach ..... D04H 1/49 428/198
(Continued)

FOREIGN PATENT DOCUMENTS

EP 2028296 A1 2/2009
EP 3121314 A1 1/2017
(Continued)

OTHER PUBLICATIONS

Extended European Search Report issued in corresponding European Patent Application No. 18154375.2 dated Mar. 21, 2018 (9 pages).

*Primary Examiner* — Andrew T Piziali
(74) *Attorney, Agent, or Firm* — Kilyk & Bowersox, P.L.L.C.

(57) ABSTRACT

The invention relates to a spunbonded nonwoven having crimped multicomponent fibers, wherein a first component of the multicomponent fibers consists of a first thermoplastic polymer material comprising a first thermoplastic base polymer and a second component of the multicomponent fibers consists of a second thermoplastic polymer material comprising a second thermoplastic base polymer that is different from the first base polymer. The at least one of the first polymer material or the second polymer material is a polymer blend that comprises, further to the respective base polymer, between 1 and 10 weight percent of a high melt flow rate polymer that has a melt flow rate of between 600 and 3,000 g/10 min. The fibers have a linear mass density of less than 1.5 denier. The average crimp number of the crimped multicomponent fibers is in the range of at least 5 and preferably at least 8 crimps per cm in the fiber. The invention further relates to a method for making such spunbonded nonwoven, a multilayer fabric wherein at least
(Continued)

Figure 1:
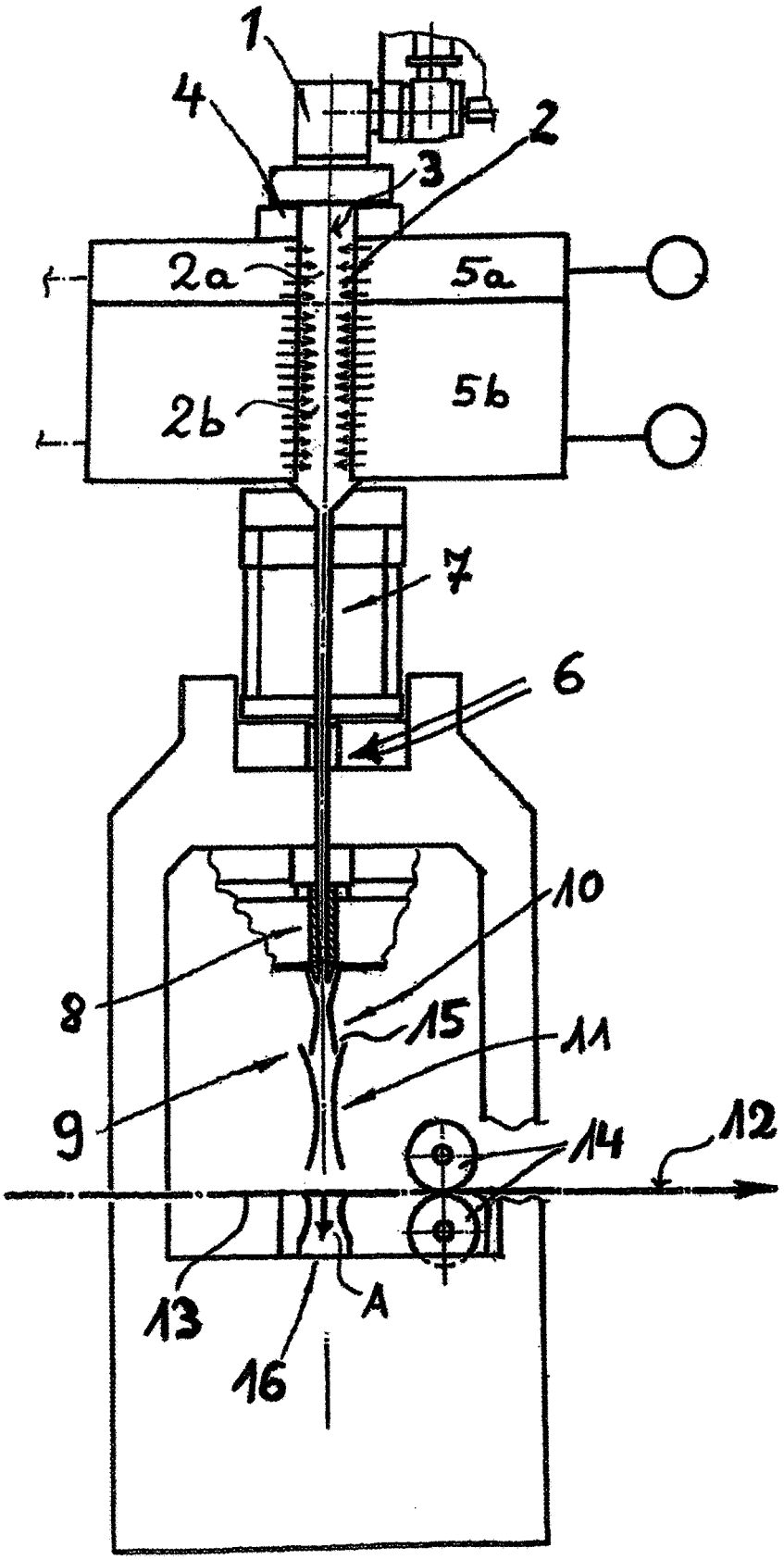

one layer comprises such spunbonded nonwoven and a hygiene product comprising such spunbonded nonwoven or multilayer fabric.

18 Claims, 8 Drawing Sheets

(51) Int. Cl.

| | |
|---|---|
| ***D04H 3/007*** | (2012.01) |
| ***D01D 5/22*** | (2006.01) |
| ***D01F 1/10*** | (2006.01) |
| ***D01F 8/06*** | (2006.01) |
| ***D04H 3/14*** | (2012.01) |
| ***D01D 5/098*** | (2006.01) |
| ***D04H 3/147*** | (2012.01) |
| ***D04H 3/16*** | (2006.01) |
| *D01F 6/46* | (2006.01) |

(52) U.S. Cl.
CPC ..... *D01F 8/06* (2013.01); *D04H 3/007* (2013.01); *D04H 3/14* (2013.01); *D04H 3/147* (2013.01); *D04H 3/16* (2013.01); *D01F 6/46* (2013.01)

(56) References Cited

U.S. PATENT DOCUMENTS

| | | | | |
|---|---|---|---|---|
| 6,454,989 | B1 * | 9/2002 | Neely | D04H 3/007 264/555 |
| 2005/0164587 | A1 * | 7/2005 | Melik | D04H 1/42 442/361 |
| 2009/0017710 | A1 * | 1/2009 | Bugada | C08F 4/65927 442/327 |

FOREIGN PATENT DOCUMENTS

| | | | |
|---|---|---|---|
| JP | 2018145536 | A | 9/2018 |
| WO | 0146506 | A2 | 6/2001 |
| WO | 2015075631 | A1 | 5/2015 |
| WO | 2017207244 | A1 | 12/2017 |

* cited by examiner

SPUNBONDED NONWOVEN WITH CRIMPED FINE FIBERS

The present invention relates to a spunbonded nonwoven comprising crimped multicomponent fibers. Due to a particular choice of fiber materials and process settings, the fibers can stably be produced at lower diameter, which leads to products of high uniformity and very high level of material softness.

Spunbonded nonwovens comprising crimped multicomponent fibers are known in the art and early technologies have been described in, e.g., U.S. Pat. No. 6,454,989 B1, EP 2 343 406 B1 and EP 1 369 518 B1. The crimped fibers make these materials high loft with improved softness and flexibility. Generally, the fibers used in these materials comprise a side-by-side, eccentric sheath-core or similar distribution of two polymers with different characteristics that causes the fiber to helically crimp during the quenching and stretching process.

The recent publication EP 3 246 444 A1 discloses spunbonded high loft materials made on the basis of a polypropylene homopolymer and a random polypropylene-ethylene copolymer, that achieve good properties in crimp and thereby softness. Other new generation high loft spunbond materials made from crimped fibers are disclosed in EP 3 246 443 A1, EP 3 121 314 A1 and EP 3 165 656 A1.

One challenge in the manufacture of high loft materials based on known processes is that the uniformity of the materials is often relatively poor. One reason for this is that the fibers tend to collide and create agglomerations when they generate crimp during the quenching and stretching process, leading to an uneven laydown and visible irregularities, especially visible in materials having basis weights of below 25 grams per square meter. There have been attempts to delay the crimping process of the fibers until after the laydown on the spinbelt, but crimping has always been poor once the fibers have been deposited on the spinbelt.

Another general challenge in the manufacture of high loft nonwoven material is the provision of materials that are as soft as possible.

The problem to be solved by the present invention is the provision of high loft spunbonded materials on the basis of crimped multicomponent fibers that have improved uniformity and softness.

Against this background the invention relates to a spunbonded nonwoven having crimped multicomponent fibers, wherein a first component of the multicomponent fibers consists of a first thermoplastic polymer material comprising a first thermoplastic base polymer and a second component of the multicomponent fibers consists of a second thermoplastic polymer material comprising a second thermoplastic base polymer that is different from the first base polymer. The first base polymer and the second base polymer have a melt flow rate of between 15 and 60 g/10 min. At least one of the first polymer material or the second polymer material is a polymer blend that comprises, further to the respective base polymer, between 1 and 10 weight percent of a high melt flow rate polymer that has a melt flow rate of between 600 and 3,000 g/10 min. The fibers have a linear mass density of less than 1.5 denier. The average crimp number of the crimped multicomponent fibers is in the range of at least 5 and preferably at least 8 crimps per cm in the fiber, as measured per Japanese standard JIS L-1015-1981 under a pre-tension load of 2 mg/denier.

The addition of a small amount of 1 to 10 weight percent of a high melt flow rate polymer of given definition to at least one and preferably both polymer materials results in a bimodal molecular weight distribution of the respective polymer material and acts as a spinning aid in the sense that it enables the spinning conditions to be adapted such that fibers of lower linear mass density can be spun, while at the same time the crimping behavior is maintained, which is not observed in a similar fashion with readymade materials having intermediate melt flow rates. As compared to previous technology where crimped multicomponent fibers of typically higher linear mass density have been spun, this leads to measurable improvements in uniformity and major improvements in softness. Also, the tensile properties have been observed to not being compromised but sometimes even improved.

The bimodal molecular weight distribution of the respective polymer material is obtained because the basis polymer and the high melt flow rate polymer have, in correlation to their different melt flow rates, typically different molecular weight distributions, where the polymer chains in the high melt flow rate polymer are, on average, shorter than in the basis polymer. In a distribution function of molecular weights, the respective polymer material hence develops two peaks/maxima at different molecular weights. The peak for the high molecular weight spinning aid is relatively smaller (due to the content of 10 wt % maximum) and is observed at a first molecular weight that is relatively smaller than a second molecular weight, at which the relatively larger peak corresponding to the basis polymer is observed. The two distinct peaks, in a typical GPC measurement, are specifically apparent at contents of between 5 and 10 wt % of the high melt flow rate polymer. At lower contents of the high melt flow rate polymer, the second peak could appear in the GPC measurement as a small rise in the region of lower molecular weight molecules.

In a preferred embodiment, the melting point of the high melt flow rate polymer exceeds 120° C. and more preferably 130° C. This is particularly true for polypropylene-based high melt flow rate polymers, which are especially suitable additives for polypropylene, polyethylene or co-polyethylene-propylene based base materials.

When reference is made herein to melting points of polymers or polymer compositions, it is understood that these are as measured according to ISO 11357-3.

When reference is made herein to melt flow rates, it is understood that these are as measured according to ISO 1133 with conditions being 230° C. and 2.16 kg.

In one embodiment the first polymer material and the second polymer material consist of the respective base polymer, the respective high melt flow rate polymer and at the most 10 wt %, preferably at the most 5 wt % and more preferably at the most 3 wt % of other components.

In one embodiment, a visbreaking additive may be added to the respective polymer materials to initiate a controlled degree of polymer chain cracking in the extruder. This may further decrease viscosity of the base polymer by a certain degree without deteriorating the bimodal nature of the mixture and the balance in polymer choice so as to maintain crimping behavior. Visbreaking additives may be deliberately added or may be present already in a high melt flow rate polymer product. The visbreaking additive may comprise an organic peroxide, an organic hydroxylamine ester, an aromatic ester, or combinations thereof. If present, it may be present in an amount of between 50 and 500 ppm and preferably 100 and 500 ppm per weight of the first or second polymer material.

Both the base polymers as well as the high melt flow rate polymer may itself be a polymer blend. Hence, in one embodiment of the invention, a blend of high melt flow rate polymers is added in an amount of 1-10 wt % total to at least one of the first polymer material or the second polymer material. Preferably still, in the interest of the bimodal behavior, the base polymers and, in particular, the high melt flow rate polymers are no blends but are one specific material that is added in an amount of 1-10 wt % total.

The first and second base polymers may have different melt flow rate, melting points, crystallinity, molecular weight distributions, chemistries and combinations of such differences such that fiber crimp can be obtained. When reference is herein made to crimped fibers, it is typically meant to describe helically crimped fibers. The nonwoven is a sheet of generally planar shape.

In one embodiment, between 1 and 10 weight percent of a high melt flow rate polymer is added to both the first and the second polymer material. The high melt flow rate polymer added to the first polymer material may be the same or different from the high melt flow rate polymer added to the second polymer material.

In one embodiment, the melt flow rate of the high melt flow rate polymer is greater than 750 g/10 min and preferably greater than 1,000 g/10 min. In one embodiment, the melt flow rate of the high melt flow rate polymer is and/or smaller than 2,200 g/10 min, preferably smaller than 1,800 g/10 min and more preferably smaller than 1,500 g/10 min. Examplary materials could have values of 1,200 g/10 min. Using materials of such melt flow rates has proven to be most effective.

In one embodiment, the level of incorporation of the high melt flow rate polymer in the first polymer material and/or the second polymer material is between 3 and 9 weight percent. These levels of incorporation have been proven to be most effective.

In one embodiment, the linear mass density of the fibers is 0.6 or higher. Preferred ranges comprise between 0.8 and 1.35 denier or between 1.0 and 1.2 denier. Fibers of such linear mass density have been proven to be readily obtainable under stable conditions when using the materials as defined in this invention. Fibers of such linear mass density have also been proven to exhibit sufficient crimp and uniform laydown.

In one embodiment, the first base polymer and/or the second base polymer is a polyolefin, preferably selected from the group consisting of a polypropylene homopolymer, a polyethylene homopolymer or a polypropylene-ethylene copolymer. Still more preferably the first base polymer and the second base polymer is a polypropylene homopolymer or a polypropylene-ethylene copolymer. As polypropylene-ethylene copolymers, preferably random copolymers are used. It is preferred to have base polymers of narrow molecular weight distribution of 7 or lower, preferably 5 or lower. Molecular weight distributions between 3 and 5 may be preferred. The base polymers may also be blends of more than one base polymer.

In one embodiment the first base polymer is a polypropylene homopolymer and the second base polymer is a polypropylene-ethylene copolymer. In this embodiment, the melt flow rates and/or the polydispersities of the polypropylene homopolymer and the polypropylene-ethylene copolymer may differ by less than 30%, less than 25% or less than 20%. In terms of absolute values, the melt flow rate of the polypropylene homopolymer and/or the polypropylene-ethylene copolymer may be in the range of 20-40 or 25-35 g/10 min. The melting points of the polypropylene homopolymer and the polypropylene-ethylene copolymer differ by 5° C. or 10° C. or more and/or differ by 20° C. or less. The melting point difference can be in the range of 5-20° C. In terms of absolute values, for example, the polypropylene homopolymer may exhibit a melting point in the range of 155-165° C. or 159-163° C. and the polypropylene-ethylene copolymer may exhibit a melting point in the range of 140-148° C. or 142-146° C.

In another embodiment, the first base polymer is a polypropylene homopolymer and the second base polymer is a blend of the same polypropylene homopolymer and another polypropylene homopolymer. In this embodiment, the melt flow rate of the polypropylene homopolymer used in the first and the second base polymer may be at least 25% or at least 35% higher than the melt flow rate of the other polypropylene homopolymer. In terms of absolute numbers, the melt flow rate of the polypropylene homopolymer used in the first and the second base polymer may be 25 g/10 min or greater and the melt flow rate of the other polypropylene homopolymer may be 25 g/10 min or smaller as measured according to ISO 1133 with conditions being 230° C. and 2.16 kg. The melting points of both polypropylene homopolymers can be similar and the difference can be in the range of less than 10° C. In terms of absolute values, for example, the melting points may be in the range of 155-165° C. or 159-163° C. The second base polymer may comprise at least 20 wt.-% of the polypropylene homopolymer that is present only in the second base polymer. In one embodiment the difference in molecular weight distribution between the polypropylene homopolymers is greater than 0.5, greater than 1.0 or greater than 1.5. In terms of absolute numbers, the molecular weight distribution of the polypropylene homopolymer used in the first and the second base polymer may be between 3.0 and 5.0 and the molecular weight distribution of the other polypropylene homopolymer may be between 5.0 and 7.0.

In one embodiment, the weight ratio of the first component to the second component in the fibers is between 90/10 and 30/70, preferably between 75/25 and 45/55.

If the high melt flow rate polymer is added only to one of the polymer materials, it is preferably added to the first polymer material.

In one embodiment, the high melt flow rate polymer is likewise a polyolefin, preferably selected from the group consisting of a polypropylene homopolymer, a polyethylene homopolymer or a polypropylene-ethylene copolymer. In one embodiment, that polyolefin is of the same group as the base material it will added to, like adding a polypropylene (homo or copolymer) to a Polypropylen base material (homo or copolymer). A polypropylene is particularly preferred. Suitable polypropylenes include, for example, Ziegler-Natta-polypropylenes or metallocene polypropylenes. Typically, homopolymers of Ziegler-Natta type are made from a low-MFR base PP and then vis-broken during compounding and granulating to achieve the intended MFR. It is conceivable that the vis-breaking additive is not completely used up till the granulating step and that some additive remains in the granulate. This can also be the case for other types of high melt flow rate polymers.

In one embodiment, the high melt flow rate polymer has a narrow molecular weight distribution of smaller 5 and preferably smaller 3 are preferred, because they usually lead to relatively stable spinning conditions. In one embodiment, the high melt flow rate polymer has a melt viscosity of between 5.000 and 15.000 mPa s and preferably of between 7.000 and 10.000 mPa s at 190° C. when determined according to ASTM D 3236. In one embodiment, the high melt flow rate polymer has a number average molecular weight of between 25.000 and 75.000 g/mol, preferably between 40.000 and 60.000 g/mol.

In one embodiment the first and/or the second polymer material consists of the base polymer and the high melt flow rate polymer, if present. Optionally, up to 5 weight percent of an additive may additionally be present.

A suitable additive that may be present in the first and/or the second polymer material is a slip agent capable of enhancing fiber softness. Suitable slip agents comprise long-chain fatty acid derivatives, for example amides from C-18 to C-22 unsaturated acids. Particularly preferred examples are oleyl amides (single unsaturated C-18) through erucyl amides (C-22 single unsaturated). Including a slip agent to the first and/or the second polymer material may lead to an improved softness, which is highly desired in hygiene applications. If present, the slip agent can in one embodiment be added, for example, at an amount of up to 5,000 ppm, preferably at an amount of 2,000-3,000 ppm based on the total weight of the respective polymer material.

In one embodiment, the layer may also consist exclusively of the fibers as described. The multicomponent fibers are preferably bicomponent fibers. In one embodiment, the multicomponent fibers have a side-by-side configuration. In alternative embodiments, the multicomponent fibers may have eccentric sheath-core or trilobal configurations.

In one embodiment the crimp amplitude is preferably in the range of below 0.30 mm and preferably between 0.15 and 0.30 mm when measured according to JIS L-1015-1981 under a pre-tension load of 2 mg/denier.

The density of the nonwoven is preferably less than 60 $mg/cm^3$ and preferably less than 50 $mg/cm^3$, which are values that are typical for high loft nonwovens with crimped fibers. Standard loft nonwovens with insufficient fiber crimp typically have densities higher than 60-70 $mg/cm^3$.

In one embodiment, the nonwoven comprises a bond pattern that is introduced by calander rolls during manufacture. In one embodiment, the bond pattern comprises a bond area of 10-16% and/or a dot density of 20-45 $dots/cm^2$ and/or a dot size of 0.35-0.55 $mm^2$ per dot.

The invention further relates to a method for making a spunbonded nonwoven according to any preceding claim in an apparatus comprising at least two extruders with a spinnerette, a drawing channel and a moving belt, wherein the fibers are spun in a spinnerette, drawn in a drawing channel and laid down on a moving belt, wherein the apparatus comprises a pressurized process air cabin from which process air is directed through the drawing channel to draw fibers. The pressure difference between the ambient pressure and the pressure in the process air cabin is at least 4,000 Pascal. The maximum air speed in the drawing channel is at least 70 m/s.

When using materials as used in conservative nonwoven technology, such pressure differences and air speeds were often too high and resulted in unstable process conditions, where fibers broke and drops formed. Owing to the rheology of the materials now used, such pressure differences and air speeds can be run stable.

In one embodiment, the pressure difference between the ambient pressure and the pressure in the process air cabin is at most 8,000 Pascal and is preferably between 5,000 and 7,000 Pascal, more preferably between 5,500 and 6,500 Pascal. A value of 6,000 Pascal has in some experiments been proven an optimal choice.

In one embodiment, the maximum air speed in the drawing channel is at most 110 m/s and preferably between 80 and 100 m/s. A value of approx. 95 m/s has in some experiments been proven an optimal choice.

The material throughput of the spinneret may be between 0.30 and 0.70 g/hole/min.

In one embodiment, the apparatus can comprise more than one cabin to direct process air of different temperatures and/or air speeds to the fibers. In this case, the pressure level in at least one of the cabins, preferably in the cabin whose process air enters closest to the spinnerette and may have the highest temperature or slowest air speed, is as defined.

The drawing channel may comprise more than one section. The drawing channel or a section of the drawing channel may get narrower with increasing distance from the spinnerette. It one embodiment the converging angle can be adjusted. The apparatus may form a closed aggregate extending between at least the point of process air entry until the end of the drawing channel, so no air can enter from the outside and no process air supplied can escape to the outside. In one embodiment the apparatus comprises at least one diffuser, which is arranged between the end of the drawing channel and the moving belt.

In one embodiment, specifically where a visbreaking additive is included to the first and/or the second base polymer, the extruder temperature of the respective extruder may be set to between 240° C. and 285° C. In the case of using an organic peroxide as visbreaking additive, extruder temperatures of 240° C. to 270° C. may be preferred. In the case of using an organic hydroxylamine ester as visbreaking additive, extruder temperatures of 250° C. to 285° C. may be preferred.

The invention also relates to a fabric comprising a spunbonded nonwoven according to the invention. The fabric may be a layered fabric comprising one or more layers of the spunbonded nonwoven in combination with one or more meltblown nonwoven layers and/or other spunbond nonwoven layers. Typical such fabrics are of the sandwich SMS-type, where S stands for spunbonded layer and M stands for meltblown layer. As understood herein, SMS includes SSMS, SMMS, etc. configurations. The spunbonded nonwoven of the invention can also be combined, in an SMS-type fabric or otherwise, with conventional spunbonded nonwoven layers outside the scope of the present invention.

Yet further, the invention relates to a hygiene product comprising a spunbonded nonwoven or a fabric according to the invention. The nonwoven materials of the present invention may be used in the hygiene industry as nonwoven sheets in hygiene products such as adult incontinence products, baby diapers, sanitary napkins and the like.

Figure 2A:
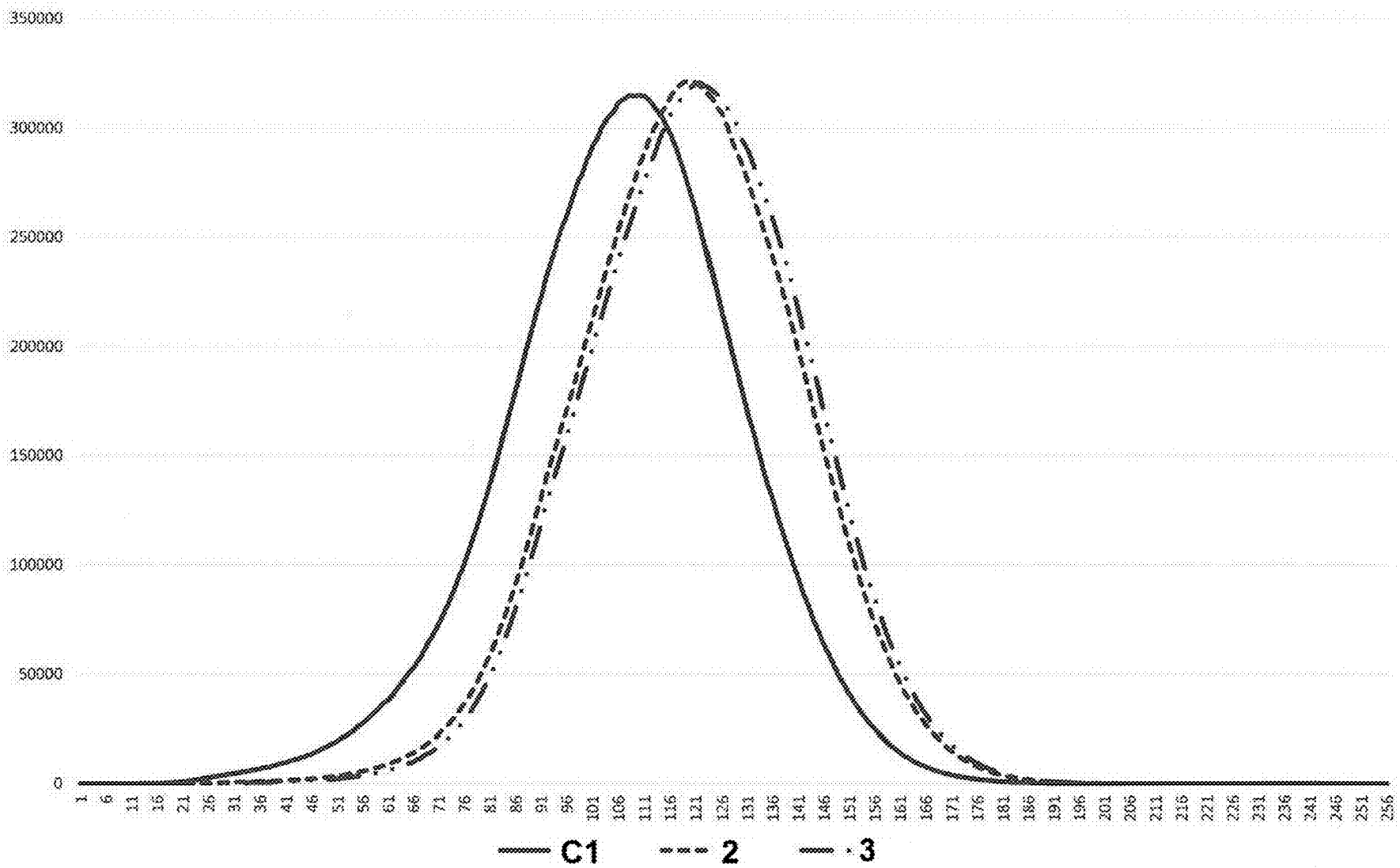
Figure 2B:
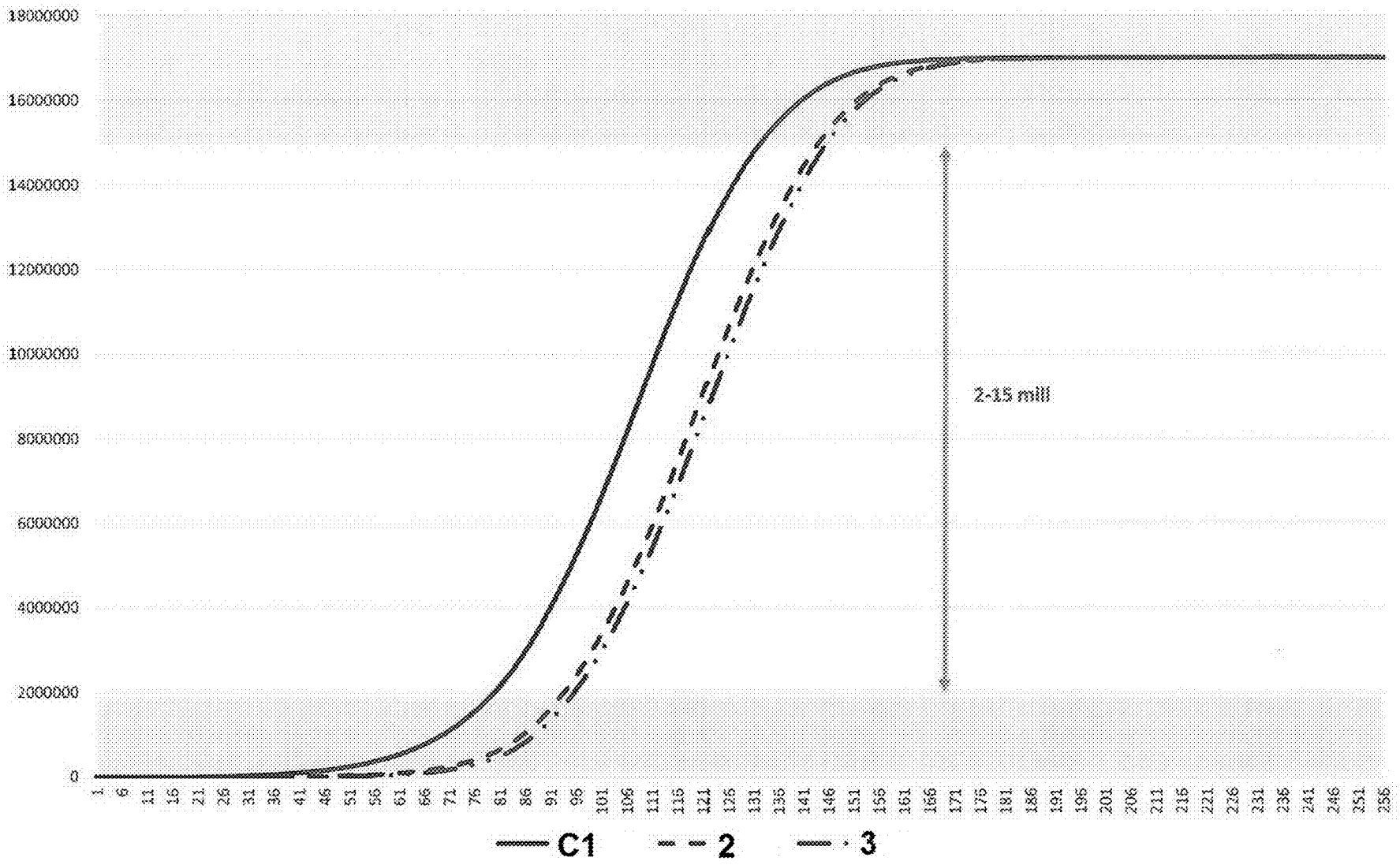
Figure 2C:
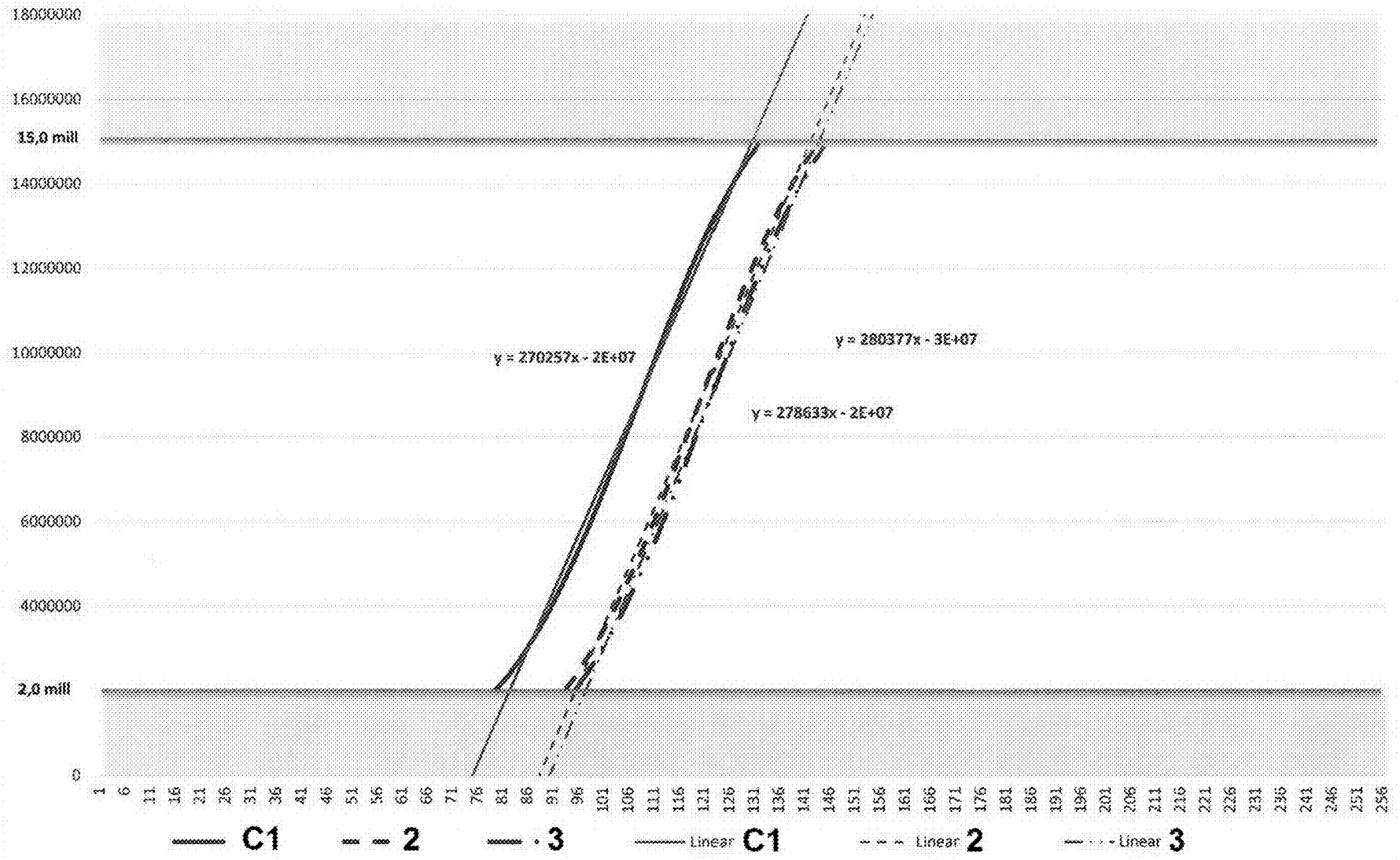
Figure 3A:
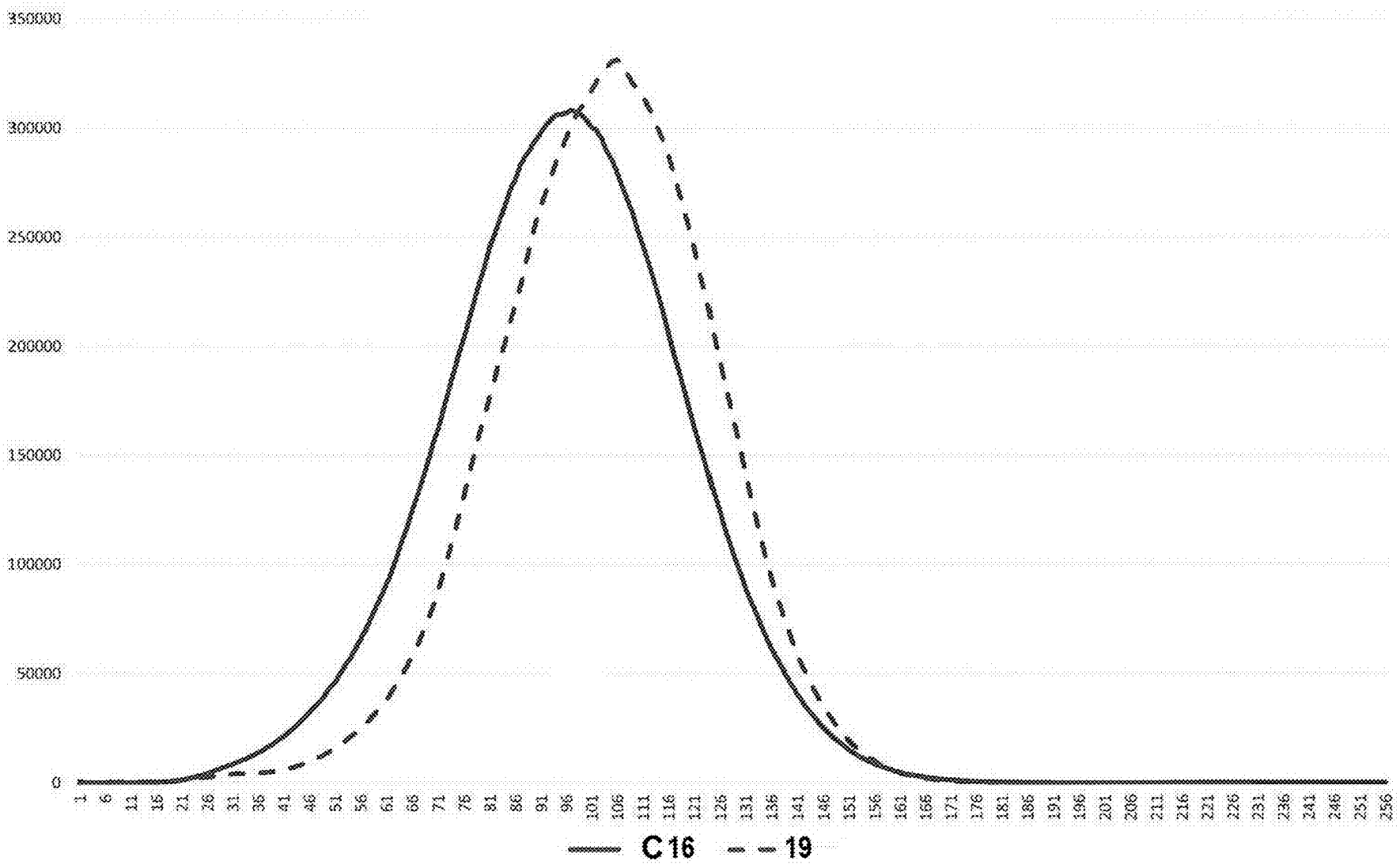
Figure 3B:
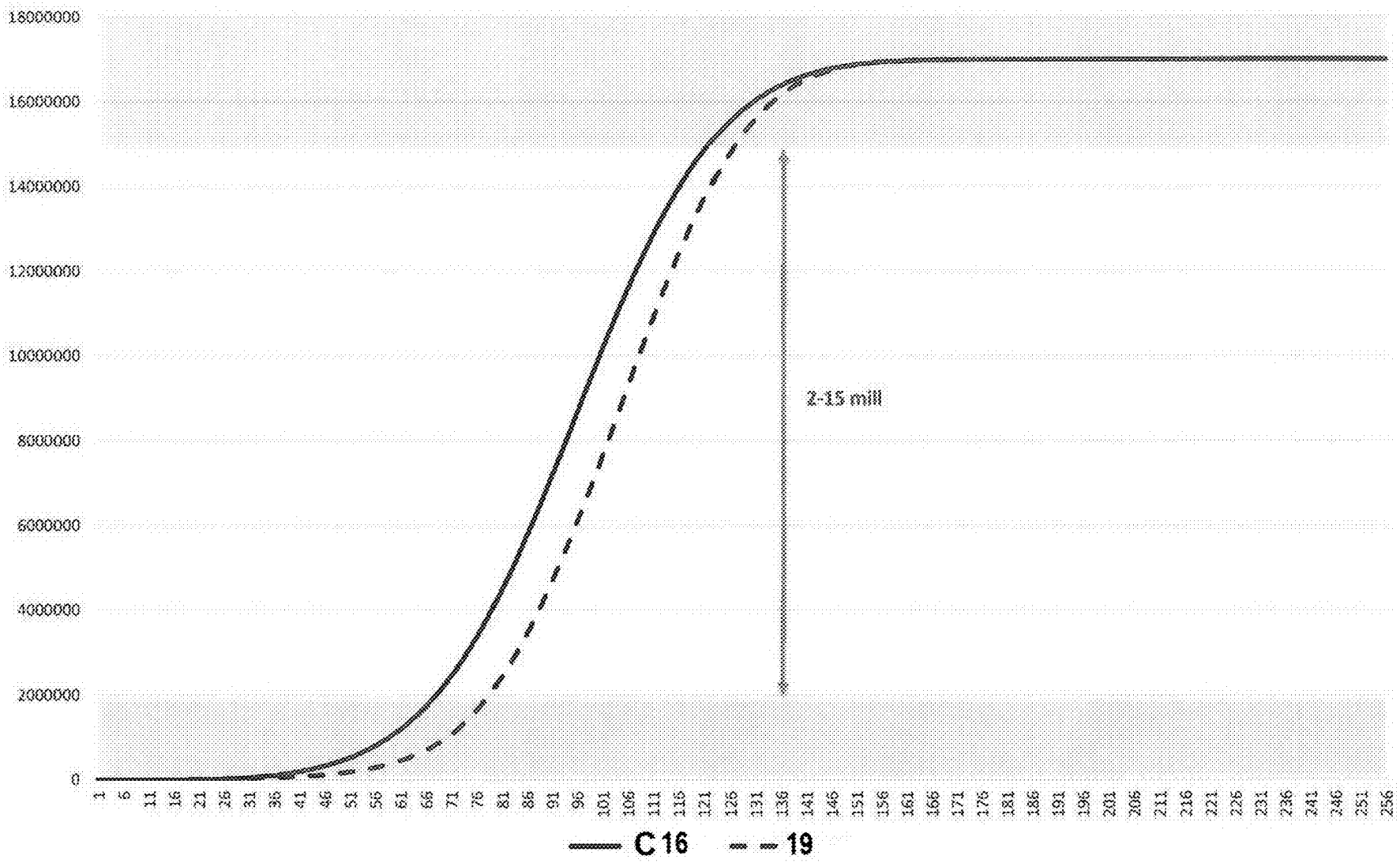
Figure 3C:
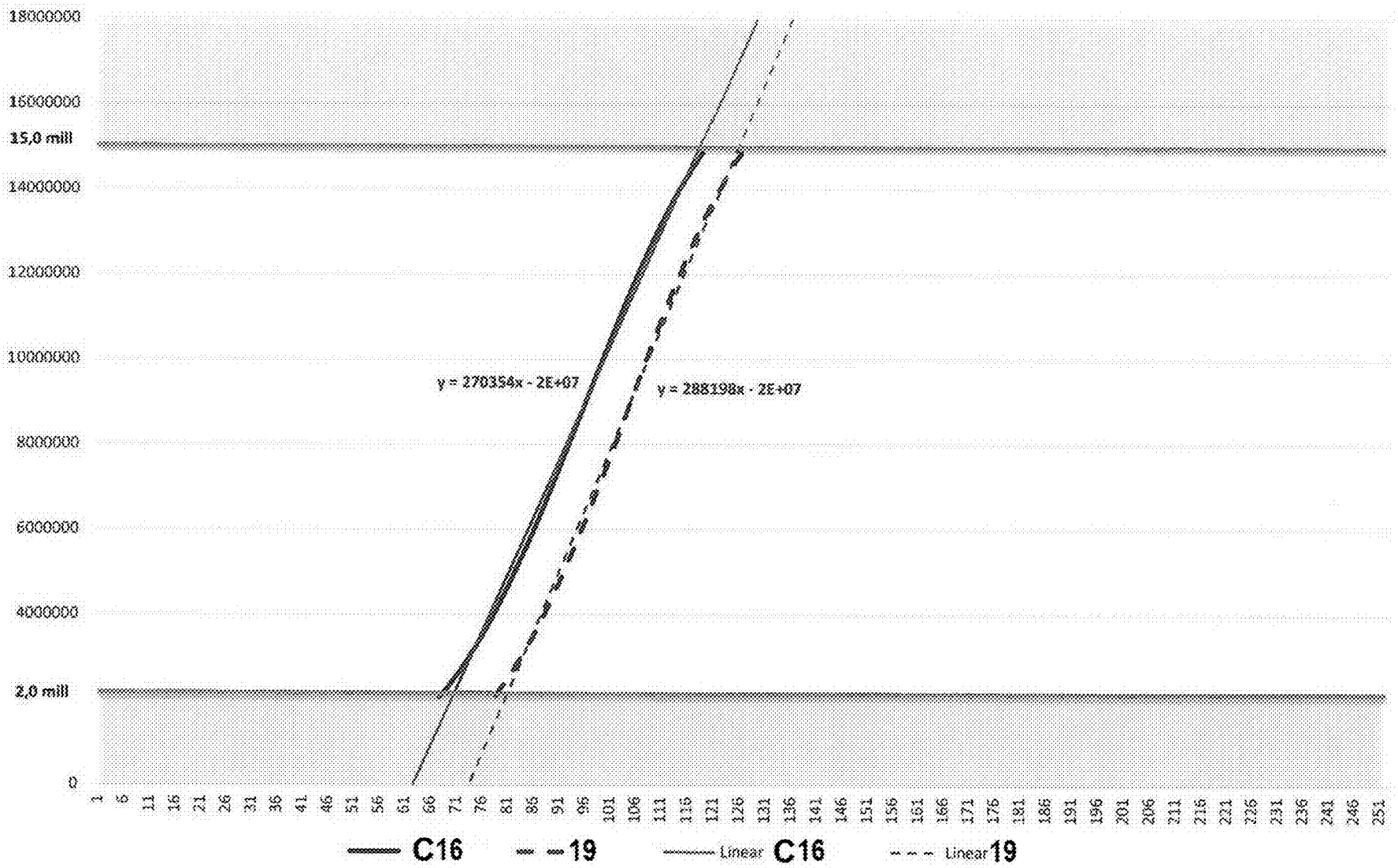
Figure 4:
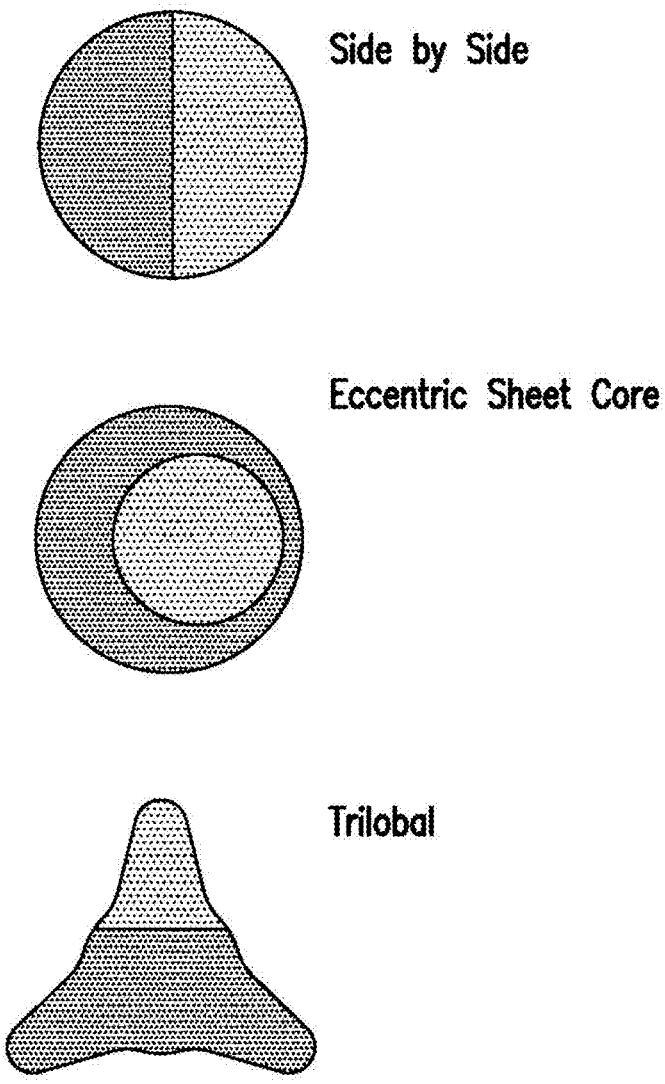

Further details and advantages of the invention will in the following be described with reference to the figures and with reference to working examples. The figures show:

FIG. 1: a schematic illustration of a spunbonding apparatus suitable for producing spunbonded nonwovens according to the invention;

FIGS. 2A-2C: diagrams showing the outcome of a uniformity analysis for the nonwovens of Comparative Example C1 and Examples 2 and 3;

FIGS. 3A-3C: diagrams showing the outcome of a uniformity analysis for the nonwovens of Comparative Example C4 and Example 7; and FIG. 4: sketches of side-by-side, eccentric sheath core and trilobal bicomponent fiber configurations.

FIG. 1 shows an apparatus that is suitable for producing spunbonded nonwovens according to the invention. Spunbonded nonwovens are produced from continuous fibers 3 of thermoplastic material, which are spun in a spinnerette 1 and subsequently passed through a cooling device 2. A monomer suctioning device 4 to remove gases in the form of decomposition products, monomers, oligomers and the like generated during the spinning of the fibers 3 is arranged between the spinnerette 1 and the cooling device 2. The monomer suctioning device 4 comprises suction openings or suction gaps.

In the cooling device 2, process air is applied to the fiber curtain from the spinnerette 1 from opposite sides. The cooling device 2 is divided into two sections 2*a* and 2*b*, which are arranged in series along the flow direction of the fibers. Thus, process air of a relatively higher temperature (for example 60° C.) can be applied to the fibers at an earlier stage in chamber section 2*a* and process air of a relatively lower temperature (for example 30° C.) can be applied to the fibers at a later stage in chamber section 2*b*. The supply of process air takes place via air supply cabins 5*a* and 5*b*, respectively. The cabin pressure within at least cabin 5*b* and preferably likewise chamber 5*a*, in agreement with the present invention, can be more than 4,000 Pascal above ambient pressure.

A drawing device 6 to draw and stretch the fibers 3 is arranged below the cooling device 2. The drawing device includes an intermediate channel 7, which preferably converges and gets narrower with increasing distance from the spinnerette 1. It one embodiment the converging angle of the intermediate channel 7 can be adjusted. After the intermediate channel 7 the fiber curtain enters the lower channel 8.

The cooling device 2 and the drawing device 6, including intermediate channel 7 and lower channel 8, are together formed as a closed aggregate, meaning that over the entire length of the aggregate, no major air flow can enter from the outside and no major process air supplied in the cooling device 2 can escape to the outside. Some fume extraction devices directly under the spinneret extracting a minor air volume can be incorporated.

The fibers 3 leaving the drawing device 6 are then passed through a laying unit 9, which comprises two successively arranged diffusers 10 and 11 are provided, each diffuser 10 and 11 having a convergent section and an adjoining divergent section. The diffuser angles, in particular the diffuser angles in the divergent regions of the diffusers 10 and 11, are adjustable. Also, the position of the diffusers 10 and 11 and hence their distance from one another and from the spinbelt 13 can be adjusted. Between the diffusers 10 and 11 is a gap 15 through which ambient air is sucked into the fiber flow space.

After passing through the laying unit 9, the fibers 3 are deposited as nonwoven web 12 on a spinbelt 13, formed from an air-permeable web. A suctioning device 16 is arranged below the laydown area of the spinbelt 13 so suck off process air, which is illustrated in FIG. 1 by the arrow A. Specifically, although this is not specifically illustrated in FIG. 1, a plurality of suctioning devices can be arranged in series along the moving direction of the spinbelt 13. The suctioning device 16 sifting directly below the laydown area is set to the highest air extraction speed, the subsequent suctioning device the second highest, and so forth.

Once deposited the nonwoven web 12 is first guided through the gap between a pair of pre-consolidation rollers 14 for pre-consolidating the nonwoven web 12. Subsequently, at a position not shown in the figure, a further consolidation and bonding of the nonwoven web 12 will take place, for example by using calendar rolls, by using a hot air knive or through hydrodynamic consolidation.

The following terms and abbreviations may be used in the working examples.

MFR: Melt Flow Rate as measured according to ISO 1133 with values shown in g/10 min and conditions being 230° C. and 2.16 kg MD: Machine Direction CD: Cross machine Direction Denier: g/9000 m filament Caliper: Thickness of a nonwoven material when measured according to WSP.120.1 (R4), pressure of 0.5 kPa GSM: nonwoven basis weight in grams per square meter TM: melting point in ° C. as determined according to DSC (Differential Scanning Calorimetry) method ISO 11357-3

MWD: Molecular Weight Distribution Mw/Mn, also referred to as the PD, the polydispersity index as measured according to ASTM D1238-13, where BHT-stabilized TCB was used as a solvent for the polymer, where the polymer concentration was 1.5 g/l and the measurement temperature was 160° C., and where the sensor was of IR type. The columns were calibrated by PS standards, with the results of the tests being converted by using the Mark Houwink equation with the parameter set PS: alpha=0.7/K=0.0138 \ PP: alpha=0.707/K=0.0242.

Opacity: expressed in average % as measured according to NWSP 060.1.R0 on a Hunter ColorFlex EZ Spectrophotometer Crimp level: expressed in crimp/cm as measured according to Japanese standard JIS L-1015-1981 under a pre-tension load of 2 mg/denier on a Textechno Favimat+ using a sensitivity of 0.05 mm Crimp amplitude: expressed in mm as measured according to Japanese standard JIS L-1015-1981 under a pre-tension load of 2 mg/denier on a Textechno Favimat+ using a sensitivity of 0.05 mm A number of crimped side-by-side was spun in a spunbonding machine as depicted in FIG. 1 using different polymer mixtures for both fiber zones and different machine settings. In FIG. 4 a typical side-by-side configuration is illustrated, along with known alternative configurations.

COMPARATIVE EXAMPLE C1 AND EXAMPLES 2-15 PP/COPP COMBINATIONS

A first series of experiments is summarized in Table 1 below:

Table 1

| Ex. | Ratio P1/P2 | P1 | P2 | Fiber Throughput (g/hole/min) | Cabin Prs. (Pa) |
|---|---|---|---|---|---|
| C1 | 50/50 | 511A | RP248R | 0.55 | 3800 |
| 2 | 50/50 | 511A (95%) HL712FB (5%) | RP248R (95%) HL712FB (5%) | 0.45 | 6000 |
| 3 | 50/50 | 511A (95%) S400 (5%) | RP248R (95%) S400 (5%) | 0.45 | 6000 |
| 4 | 50/50 | 511A (95%) HL712FB (3%) | RP248R (95%) HL712FB (3%) | 0.45 | 5000 |
| 5 | 50/50 | 511A (95%) HL712FB (5%) | RP248R (95%) HL712FB (5%) | 0.45 | 5000 |
| 6 | 50/50 | 511A (95%) HL712FB (5%) | RP248R (95%) HL712FB (5%) | 0.45 | 7400 |
| 7 | 50/50 | 511A (92%) HL712FB (8%) | RP248R (92%) HL712FB (8%) | 0.45 | 5000 |
| 8 | 50/50 | 511A (92%) HL712FB (8%) | RP248R (92%) HL712FB (8%) | 0.45 | 7800 |
| 9 | 50/50 | 511A (92%) HL712FB (8%) | RP248R (92%) HL712FB (8%) | 0.52 | 5000 |
| 10 | 50/50 | 511A (92%) HL712FB (8%) | RP248R (92%) HL712FB (8%) | 0.52 | 6000 |
| 11 | 50/50 | 511A (92%) HL712FB (8%) | RP248R (92%) HL712FB (8%) | 0.52 | 8000 |
| 12 | 50/50 | 511A (95%) MF650X (5%) | RP248R (95%) MF650X (5%) | 0.45 | 5000 |
| 13 | 50/50 | 511A (92%) MF650X (8%) | RP248R (92%) MF650X (8%) | 0.45 | 5000 |

Table 1-continued

| Ex. | Ratio P1/P2 | P1 | P2 | Fiber Throughput (g/hole/min) | Cabin Prs. (Pa) |
|---|---|---|---|---|---|
| 14 | 50/50 | 511A (95%) HL708FB (5%) | RP248R (95%) HL708FB (5%) | 0.45 | 5000 |
| 15 | 50/50 | 511A (92%) HL708FB (8%) | RP248R (92%) HL708FB (8%) | 0.45 | 5000 |

On the Reicofil machine used for the experiments and at an SAS gap of 22 mm, the cabin pressure of 3,800 Pa applied in Comparative Example C1 resulted in a maximum air speed of approx. 75 m/s and an air volume flow of approx 7,500 $m^3$/h in the drawing channel. A cabin pressure of 6,000 Pa applied in Examples 2-15 resulted in a maximum air speed of approx. 95 m/s and an air volume flow of approx 9,500 $m^3$/h in the drawing channel.

The polymer materials used in the experiments were the following: The material 511A is a homo-polypropylene from Sabic with a MWD of 3-5 (manufacturer indication) and a MFR of 25 g/10 min. It has a melting temperature of between 160-166° C. The material RP248R is a random polypropylene-ethylene copolymer from Lyondellbasell with a MWD of 3-5, a MFR of 30 g/10 min and a melting temperature of 144° C. The material HL712FB is a Ziegler-Natta polypropylene homopolymer from *Borealis* with a narrow MWD, a MFR of 1,200 g/10 min and a melting temperature of 158° C. The material MF650X is a Metallocene polypropylene homopolymer from LyndonellBasell with a MFR of 1,200 g/10 min and a melting temperature of greater 150° C. The material HL708FB is a Ziegler-Natta polypropylene homopolymer from *Borealis* with a MFR of 800 g/10 min and a melting temperature of 158° C. The material S400 is a low molecular weight polyolefin from Idemitsu, a MWD of 2, a MFR of >2,000 g/10 min and a melting point of 80° C. (as determined to a test standard of the manufacturer Idemitsu).

In Comparative Example C1, the cabin pressure of 3,800 Pa is the maximum cabin pressures that could be used with the given polymers. Higher cabin pressures resulted in unstable spinning conditions and let to fiber breakage and drop forming. In the inventive Examples 2-15, cabin pressures of 5,000 Pa and higher could be used at stable spinning conditions and without causing any filament breakage or forming of drops.

In all, Comparative Example C1 and Examples 2-15, the nonwoven materials were thermally bonded with a heated calendar steel roller with an open dot bonding pattern with an bonding area of 12% and a point bond concentration of 24 dots/$cm^2$ running against a smooth steel roller. The temperature of the patterned roller was set to 140° C., the temperature of the smooth roller was set to 135° C. and the linear contact force was kept constant at 60 daN/cm.

The properties of the resultant spunbond nonwoven materials are summarized in Tables 2-4 below.

Table 2

| Ex. | Basis Weight (g/$m^2$) | Thickness (mm) | Density (mg/$cm^3$) | Denier (g/9000 m) | Uniformity Index/slope |
|---|---|---|---|---|---|
| Cl | 19.7 | 0.43 | 45.8 | 1.48 | 270.257 |
| 2 | 20.9 | 0.44 | 47.5 | 1.05 | 278.633 |
| 3 | 21.1 | 0.48 | 44.0 | 1.10 | 280.377 |
| 4 | 20.1 | 0.33 | 60.9 | 1.19 | |
| 5 | 19.9 | 0.36 | 55.3 | 1.32 | |
| 6 | 20.0 | 0.33 | 60.6 | 1.10 | |

Table 2-continued

| Ex. | Basis Weight (g/$m^2$) | Thickness (mm) | Density (mg/$cm^3$) | Denier (g/9000 m) | Uniformity Index/slope |
|---|---|---|---|---|---|
| 7 | 20.0 | 0.38 | 52.6 | 1.13 | |
| 8 | 20.0 | 0.33 | 60.6 | 1.04 | |
| 9 | 20.0 | 0.41 | 48.8 | 1.31 | |
| 10 | 20.0 | 0.38 | 52.6 | 1.27 | |
| 11 | 20.0 | 0.35 | 57.1 | 1.12 | |
| 12 | 18.0 | 0.25 | 72.0 | 1.27 | |
| 13 | 18.0 | 0.35 | 51.4 | 1.19 | |
| 14 | 18.0 | 0.34 | 52.9 | 1.17 | |
| 15 | 18.0 | 0.35 | 51.4 | 1.16 | |

Table 3

| Ex. | TSMD (N/50 mm) | TEMD (%) | TSCD (N/50 mm) | TECD (%) |
|---|---|---|---|---|
| Cl | 23.5 | 154 | 13.6 | 180 |
| 2 | 29.0 | 140 | 16.0 | 168 |
| 3 | 30.8 | 160 | 16.0 | 191 |
| 4 | 27.4 | 129 | 17.1 | 163 |
| 5 | 27.4 | 133 | 15.5 | 141 |
| 6 | 34.1 | 123 | 19.6 | 156 |
| 7 | 24.8 | 122 | 14.5 | 143 |
| 8 | 34.3 | 111 | 19.3 | 143 |
| 9 | 23.1 | 119 | 13.2 | 152 |
| 10 | 26.2 | 115 | 15.5 | 145 |
| 11 | 32.3 | 116 | 17.1 | 138 |
| 12 | 26.4 | 135 | 15.0 | 163 |
| 13 | 26.6 | 145 | 14.6 | 176 |
| 14 | 26.6 | 135 | 16.4 | 171 |
| 15 | 25.4 | 129 | 15.1 | 170 |

Table 4

| Ex. | Crimp level (crimps/cm) | Crimp amplitude (mm) | Opacity (%) |
|---|---|---|---|
| Cl | 9.03 | 0.29 | 22.22 |
| 2 | 14.30 | 0.26 | 28.37 |
| 3 | 15.26 | 0.21 | 28.03 |
| 4 | 12.07 | 0.19 | N/A |
| 5 | 11.40 | 0.18 | N/A |
| 6 | 11.80 | 0.18 | N/A |
| 7 | 14.00 | 0.20 | N/A |
| 8 | N/A | N/A | N/A |
| 9 | N/A | N/A | N/A |
| 10 | N/A | N/A | N/A |
| 11 | N/A | N/A | N/A |
| 12 | 11.40 | 0.23 | N/A |
| 13 | 9.42 | 0.19 | N/A |
| 14 | 9.10 | 0.19 | N/A |
| 15 | 9.90 | 0.19 | N/A |

N/A indicates that a property was not determined experimentally for that respective sample.

The product of Comparative Example C1 comprises crimped fibers in the normal denier range of about 1.5, which is a typical minimum value achievable with conservative crimped spunbond technology. Attempts to obtain lower denier fibers by simply increasing cabin pressure are unsuccessful because this will lead to fiber breakage. The inventive Examples 2-15 allow machine settings to be adapted to obtain lower denier fibers that still generate spontaneous crimp.

As apparent from Table 2, the addition of only 5% of a high MFR polypropylene additive to the polymers for both fiber sections leads to a material combination where higher cabin pressures can stably be used to obtain lower denier materials. The thicknesses and densities for the inventive Examples 2-15, respectively, indicate that the overall crimp level of the fibers remains unchanged despite the lower denier, which is important to the softness of the material. The measured values for crimp numbers and crimp amplitudes confirm this observation. A shift to a larger number of smaller amplitude crimps, so a shift to finer crimps can be observed, which has, however, no apparent negative influence on loft.

As apparent from Table 3, for these PP/Co-PP materials, tensile properties are even improved in the inventive Examples 2-15 over the reference material of Comparative Example C1. An increase in both TSMD and TSCD is noted. The comparison is significant because the materials all have similar thicknesses and basis weights. The improvement in tensile properties is surprising because it would be expected that adding high MFR polymers such as HL712FB or S400 to the polymer streams should have a negative impact to the tensile strength of the individual fibers, especially as they are thinner. It is suspected, however, that this possible decrease in single fiber stability is usually overcompensated by an increase in the number of fibers.

Also, the uniformity improved significantly in the inventive Examples 2 and 3, for which this property was measured, over Comparative Example C1. This is believed to be due to the lower denier range and at the same time due to less fiber collisions and more available air volume at the diffusors, which ultimately stands in connection with the higher cabin pressure. Specifically, to determine the uniformity of the laydown, a scan of the nonwovens with a subsequent analysis of the scan on a greyscale pixel level is performed. A material sheet having A3 size was scanned to obtain a greyscale image of 3510×4842, i.e., close to 17 million pixels. Each single pixel was then rated 0 to 255 with 0 being totally black level and 255 being white. The outcome of this analysis for the nonwovens of Comparative Example C1 and Examples 2 and 3 can be illustrated in the diagrams of FIGS. 2A to 2C. In FIG. 2A, the pixel count (y-axis) has been plotted against the pixel rating (x-axis) for each example. FIG. 2B shows a curve obtained by integrating the plot of FIG. 2A, where the y-axis then shows the sum of all pixels of a rating lower or equivalent to the current position on the x-axis. FIG. 2C analyzes the slope of the curve of FIG. 2B in the section between $y=2.10^6$ to $y=15.10^6$. One thing that can be noted from FIG. 2A is that the peak becomes higher in Examples 2 and 3. Because the same amount of pixels is evaluated in either case, a higher peak corresponds to a narrower distribution in pixel rating, which in turn points to a more uniform material. Another thing that can be noted is that the curves of Examples 2 and 3 are narrower in the boundary areas where pixel counts are lower than 50.000, meaning that there are less "extreme" areas of fiber densities that are much lower or much higher than average. Both these findings are confirmed in FIG. 2B and particularly FIG. 2C, where the higher pixel slope measured in FIG. 2C quantifies the visual finding of a more uniform distribution. Yet another thing that can be noted from the FIGS. 2A-2C is that the average greyscale in Examples 2 and 3 is higher than in Comparative Example C1. This is a consequence of the thinner fiber diameters and the generally more dense appearance, although the actual density expressed in $g/cm^3$ remains more or less unchanged. The latter finding is confirmed by the higher opacity values obtained for Examples 2-3.

COMPARATIVE EXAMPLE C16 AND EXAMPLES 17-27 PP/PP COMBINATIONS

A second series of experiments is summarized in Table 5 below:

Table 5

| Ex. | Ratio P1/P2 | P1 | P2 | Fiber Throughput (g/hole/min) | Cabin Prs. (Pa) |
|---|---|---|---|---|---|
| C16 | 70/30 | 3155 | 3155 (75%)<br>552N (25%) | 0.52 | 3200 |
| 17 | 70/30 | 3155 (88%)<br>HL712FB (8%)<br>Soft (4%) | HG475FB (68%)<br>552R (25%)<br>HL712FB (3%)<br>Soft (4%) | 0.45 | 6000 |
| 18 | 70/30 | 3155 (91%)<br>S400 (5%)<br>Soft (4%) | HG475FB (66%)<br>552R (25%)<br>S400 (5%)<br>Soft (4%) | 0.45 | 6000 |
| 19 | 70/30 | HG475FB (88%)<br>HL712FB (8%)<br>Soft (4%) | HG475FB (71%)<br>552R (25%)<br>Soft (4%) | 0.45 | 6000 |
| 20 | 70/30 | 3155 (93%)<br>HL712FB (3%)<br>Soft (4%) | HG475FB (70%)<br>552R (25%)<br>HL712FB (1%)<br>Soft (4%) | 0.45 | 5000 |
| 21 | 70/30 | 3155 (91%)<br>HL712FB (5%)<br>Soft (4%) | HG475FB (69%)<br>552R (25%)<br>HL712FB (2%)<br>Soft (4%) | 0.45 | 5000 |
| 22 | 70/30 | 3155 (88%)<br>HL712FB (8%)<br>Soft (4%) | HG475FB (68%)<br>552R (25%)<br>HL712FB (3%)<br>Soft (4%) | 0.45 | 5000 |
| 23 | 70/30 | 3155 (88%)<br>HL712FB (8%)<br>Soft (4%) | HG475FB (68%)<br>552R (25%)<br>HL712FB (3%)<br>Soft (4%) | 0.45 | 6000 |
| 24 | 70/30 | 3155 (88%)<br>HL712FB (8%)<br>Soft (4%) | HG475FB (68%)<br>552R (25%)<br>HL712FB (3%)<br>Soft (4%) | 0.45 | 8000 |
| 25 | 70/30 | 3155 (88%)<br>HL712FB (8%)<br>Soft (4%) | HG475FB (68%)<br>552R (25%)<br>HL712FB (3%)<br>Soft (4%) | 0.52 | 5000 |
| 26 | 70/30 | 3155 (88%)<br>HL712FB (8%)<br>Soft (4%) | HG475FB (68%)<br>552R (25%)<br>HL712FB (3%)<br>Soft (4%) | 0.52 | 6000 |
| 27 | 70/30 | 3155 (88%)<br>HL712FB (8%)<br>Soft (4%) | HG475FB (68%)<br>552R (25%)<br>HL712FB (3%)<br>Soft (4%) | 0.52 | 9000 |

The cabin pressure of 3200 Pa applied in Comparative Example C16 resulted in maximum air speeds and an air volume flow only slightly lower than in Comparative Example C1 described above. In the inventive Examples 17-27 the maximum air speeds and air volume flows were higher.

The polymer materials used in the experiments were the following: The material 3155 is a homo-polypropylene from Exxonmobil with a MWD of 3-5 and a MFR of 35 g/10 min. The material 552N is a homo-polypropylene from Lyondellbasell with a MWD of 5-7 and a MFR of 13 g/10 min. The material 552R is a homo-polypropylene from Lyondellbasell with a MWD of 5-7 and a MFR of 25 g/10 min. The material HG475FB is a homo-polypropylene from *Borealis* with a MWD of 3-5 and a MFR of 27 g/10 min. All these homo-polypropylenes have melting points in the area of between 160-166° C. The material Soft is a slip agent with 10%

Erucamide in a polypropylene masterbatch (Constab SL 05068PP). The materials HL712FB and S400 are as described above.

In Comparative Example C16, the cabin pressure of 3200 Pa is the maximum cabin pressures that could be used with the given polymers. Higher cabin pressures resulted in unstable spinning conditions and let to fiber breakage and drop forming. In the inventive Examples 17-27 a cabin pressure of 6,000 Pa could be used at stable spinning conditions and without causing any filament breakage or forming of drops.

Other settings were similar to Examples C1/2-15, with the exception that the temperature and linear pressure conditions of the calendar rolls were modified to account for the polypropylene-only nature of these materials.

The properties of the resultant spunbond nonwoven materials are summarized in Tables 6-8 below.

Table 6

| Ex. | Basis Weight ($g/m^2$) | Thickness (mm) | Density ($mg/cm^3$) | Denier (g/9000 m) | Uniformity Index/slope |
|---|---|---|---|---|---|
| C16 | 23.6 | 0.58 | 40.7 | 1.79 | 270.354 |
| 17 | 26.4 | 0.60 | 44.0 | 1.13 | N/A |
| 18 | 25.4 | 0.57 | 44.6 | 1.16 | N/A |
| 19 | 19.7 | 0.55 | 35.8 | 1.16 | 288.198 |
| 20 | 23.9 | 0.64 | 37.3 | 1.16 | N/A |
| 21 | 23.7 | 0.63 | 39.6 | 1.15 | N/A |
| 22 | 25.0 | 0.58 | 43.1 | 1.29 | N/A |
| 23 | 25.0 | 0.56 | 44.6 | 1.14 | N/A |
| 24 | 25.0 | 0.53 | 47.2 | 1.04 | N/A |
| 25 | 25.0 | 0.57 | 43.9 | 1.45 | N/A |
| 26 | 25.0 | 0.57 | 43.9 | 1.37 | N/A |
| 27 | 25.0 | 0.55 | 45.5 | 1.09 | N/A |

Table 7

| Ex. | TSMD (N/50 mm) | TEMD (%) | TSCD (N/50 mm) | TECD (%) |
|---|---|---|---|---|
| C16 | 19.2 | 158 | 10.4 | 192 |
| 17 | 28.9 | 150 | 25.6 | 177 |
| 18 | 34.9 | 153 | 19.6 | 189 |
| 19 | 17.6 | 212 | 9.1 | 247 |
| 20 | 25.2 | 200 | 13.6 | 257 |
| 21 | 26.7 | 196 | 14.0 | 222 |
| 22 | 23.2 | 177 | 12.4 | 225 |
| 23 | 24.3 | 188 | 11.6 | 234 |
| 24 | 23.3 | 180 | 11.3 | 241 |
| 25 | 22.1 | 147 | 11.5 | 171 |
| 26 | 20.5 | 183 | 11.8 | 234 |
| 27 | 21.7 | 164 | 10.1 | 176 |

Table 8

| Ex. | Crimp level (crimps/cm) | Crimp amplitude (mm) | Opacity (%) |
|---|---|---|---|
| C16 | N/A | N/A | N/A |
| 17 | 10.70 | 0.29 | 37.69 |
| 18 | 13.38 | 0.25 | 35.54 |
| 19 | 13.38 | N/A | 31.94 |
| 20 | 14.70 | 0.22 | N/A |
| 21 | 13.40 | 0.21 | N/A |
| 22 | 16.20 | 0.20 | N/A |
| 23 | 20.07 | 0.15 | N/A |
| 24. | N/A | N/A | N/A |
| 25 | N/A | N/A | N/A |
| 26 | N/A | N/A | N/A |
| 27 | N/A | N/A | N/A |

N/A indicates that a property was not determined experimentally for that respective sample.

Similar to the observations that could be made to Example C1/2-15, the product of Comparative Example C16 comprises a higher fiber diameter of about 1.8 denier, while denier could be significantly decreased in Examples 17-27.

The addition of small amounts of a high MFR polypropylene additive to the polymers for both fiber sections (Examples 17-18, 20-27) or even only the more voluminous fiber section (Example 19) leads to a material combination where higher cabin pressures can stably be used to obtain lower denier materials. The material thicknesses remain essentially unchanged despite the lower denier. The tensile properties are improved in some inventive Examples over the reference material of Comparative Example C16 and in some instances an increase in both TSMD and TSCD is noted. In all inventive Examples, they are at least not decreased, despite the sometimes lower basis weight.

While no crimp level or opacity measurements for Comparative Example C16 have been carried out, the data for Examples 17-18 are similar to the data for Examples 2-3 and are hence representative for the desired beneficial outcome.

Uniformity measurements comparing Comparative Example 16 and Example 19 are depicted in FIGS. 3A-3C. Like in the case of Examples C1/2-3, an improvement is clearly visible.

The perceived softness of the materials of all Inventive Examples 2-15 and 17-27 is very high and similar to the perceived softness of a microfleece woven web, which by many in the hygiene industry is viewed as the ultimately material when it comes to ratings of softness for the use in personal care products like baby diapers, feminine care protection pads and adult incontinence hygiene products.

The invention claimed is:

1. A spunbonded nonwoven having crimped multicomponent fibers, wherein a first component of the multicomponent fibers consists of a first thermoplastic polymer material comprising a first thermoplastic base polymer and a second component of the multicomponent fibers consists of a second thermoplastic polymer material comprising a second thermoplastic base polymer that is different from the first thermoplastic base polymer, wherein the first thermoplastic base polymer and the second thermoplastic base polymer have a melt flow rate of between 15 and 60 g/10 min as measured according to ISO 1133 with conditions being 230° C. and 2.16 kg, wherein the first thermoplastic polymer material and the second thermoplastic polymer material are each a respective polymer blend that comprises, further to the respective thermoplastic base polymer, between 1 and 10 weight percent of a high melt flow rate polymer based on total weight of said respective polymer blend;

wherein the high melt flow rate polymer has a melt flow rate of between 600 and 3,000 g/10 min as measured according to ISO 1133 with conditions being 230° C. and 2.16 kg;

wherein the crimped multicomponent fibers have a linear mass density of between 0.6 and 1.5 denier; and wherein the average crimp number of the crimped multicomponent fibers is in the range of at least 5 crimps per cm in the fiber, as measured per Japanese standard JIS L-1015-1981 under a pre-tension load of 2 mg/denier.

2. The spunbonded nonwoven according to claim 1, wherein the high melt flow rate polymer has a melting point of greater 120° C. as measured according to ISO 11357-3.

3. The spunbonded nonwoven according to claim 1, wherein the melt flow rate of the high melt flow rate polymer is greater than 750 g/10 min as measured according to ISO 1133 with conditions being 230° C. and 2.16 kg.

4. The spunbonded nonwoven according to claim 1, wherein the melt flow rate of the high melt flow rate polymer is smaller than 2,200 g/10 min, as measured according to ISO 1133 with conditions being 230° C. and 2.16 kg.

5. The spunbonded nonwoven according to claim 1, wherein the level of incorporation of the high melt flow rate polymer in the first polymer material and/or the second polymer material is between 3 and 9 weight percent.

6. The spunbonded nonwoven according to claim 1, wherein the first base polymer and/or the second base polymer is a polyolefin.

7. The spunbonded nonwoven according to claim 1, wherein the high melt flow rate polymer is a polypropylene homopolymer.

8. The spunbonded nonwoven according to claim 1, wherein the first and/or the second polymer material further comprises a slip agent, wherein the slip agent is present in the respective polymer material in an amount of up to 5,000 ppm, based on the total weight of the respective polymer material.

9. The spunbonded nonwoven of claim 1, wherein the average crimp number of the crimped multicomponent fibers is in the range of at least 8 crimps per cm in the fiber, as measured per Japanese standard JIS L-1015-1981 under a pre-tension load of 2 mg/denier.

10. The spunbonded nonwoven according to claim 1, wherein the melt flow rate of the high melt flow rate polymer is greater than 1,000 g/10 min as measured according to ISO 1133 with conditions being 230° C. and 2.16 kg.

11. The spunbonded nonwoven according to claim 1, wherein the melt flow rate of the high melt flow rate polymer is smaller than 1,800 g/10 min as measured according to ISO 1133 with conditions being 230° C. and 2.16 kg.

12. The spunbonded nonwoven according to claim 1, wherein the linear mass density of the crimped multicomponent fibers is between 0.8 and 1.35 denier.

13. The spunbonded nonwoven according to claim 6, wherein the polyolefin is a polypropylene homopolymer, a polyethylene homopolymer or a polypropylene-ethylene copolymer.

14. A multilayer fabric wherein at least one layer comprises a spunbonded nonwoven according to claim 1.

15. The multilayer fabric according to claim 14, wherein the multilayer fabric comprises at least two spunbonded nonwoven layers (S) and at least one meltblown nonwoven layer (M) in an SMS configuration.

16. A hygiene product comprising a spunbonded nonwoven according to claim 1 or a multilayer fabric having multiple layers and at least one layer comprises the spunbonded nonwoven.

17. A method for making the spunbonded nonwoven according to claim 1 in an apparatus comprising at least two extruders with a spinnerette, a drawing channel and a moving belt, wherein the fibers are spun in a spinnerette, drawn in a drawing channel and laid down on a moving belt, wherein the apparatus comprises a pressurized process air cabin from which process air is directed through the drawing channel to draw fibers, wherein the pressure difference between the ambient pressure and the pressure in the process air cabin is at least 4,000 Pascal and/or wherein the maximum air speed in the drawing channel is at least 70 m/s.

18. The method according to claim 17, wherein the pressure difference between the ambient pressure and the pressure in the process air cabin is at most 8,000 Pascal and/or wherein the maximum air speed in the drawing channel is at most 110 m/s and/or wherein the extruder temperature of at least one of the extruders is between 240° C. and 285° C.

* * * * *